US005770048A

United States Patent [19]

Scaringe et al.

[11] Patent Number: 5,770,048

[45] Date of Patent: Jun. 23, 1998

[54] METHOD FOR REMOVAL OF ACID FROM COMPRESSOR OIL

[75] Inventors: Robert Peter Scaringe, Rockledge; Nidal Abdul Samad, Palm Bay; Lawrence Robert Grzyll, Merritt Island, all of Fla.

[73] Assignee: Mainstream Engineering Corporation, Rockledge, Fla.

[21] Appl. No.: 519,095

[22] Filed: Aug. 24, 1995

[51] Int. Cl.[6] ..... C10G 21/16

[52] U.S. Cl. ..... 208/262.1; 208/291; 208/180; 252/68; 252/69; 585/864; 508/111; 62/DIG. 20

[58] Field of Search ..... 208/263, 262.1, 208/291, 180, 240, 348, 273, 274, 281; 62/84, 85, 474, 475, DIG. 20; 252/68, 69; 203/63, 66, 6, 7; 585/864; 508/111, 583

[56] References Cited

U.S. PATENT DOCUMENTS

| | | | |
|---|---|---|---|
| 1,766,768 | 6/1930 | Werkenthin | 208/291 |
| 2,085,545 | 6/1937 | Retailliau | 208/274 |
| 2,600,537 | 6/1952 | Honetcutt | 208/263 |
| 2,610,209 | 9/1952 | Honeycutt | 208/263 |
| 2,666,796 | 1/1954 | Gorin et al. | 208/263 |
| 2,808,431 | 10/1957 | Fierce | 208/263 |
| 2,850,435 | 9/1958 | Fierce et al. | 208/263 |
| 3,119,244 | 1/1964 | Fabian | 62/501 |
| 3,126,331 | 3/1964 | Landis et al. | 208/240 |
| 3,846,288 | 11/1974 | Chun et al. | 208/240 |
| 5,015,441 | 5/1991 | Uratani | 422/12 |
| 5,292,993 | 3/1994 | Halsig | 204/63 |
| 5,503,757 | 4/1996 | Ignatow et al. | 252/68 |

FOREIGN PATENT DOCUMENTS

WO 94/10268 5/1994 WIPO .

OTHER PUBLICATIONS

Material Safety Data Sheets for Thawzone (4 pages) and supply catalog page for Thawzone (1 page), Data Sheets Nov. 16. 1991, Catalog—No Date.

*Primary Examiner*—Walter D. Griffin
*Attorney, Agent, or Firm*—Evenson, McKeown, Edwards & Lenahan, P.L.L.C.

[57] ABSTRACT

An alcohol, specifically ethanol, methanol and isopropanol, is used to remove acid from a refrigeration system, a heat pump or an air conditioner. The alcohol vaporizes acid, primarily inorganic acid, in the system and, in the filter/dryer, reacts with surfaces or is adsorbed. The alcohol, the quantity of which is determined from the capacity of the filter/dryer, is introduced into the compressor oil sump for thorough mixing with the oil during compressor lubrication.

15 Claims, 2 Drawing Sheets

METHOD FOR REMOVAL OF ACID FROM COMPRESSOR OIL

BACKGROUND AND SUMMARY OF THE INVENTION

The present invention relates to an acid removal method for compressor oil, and more particularly, to a method which significantly improves removal of acid without creating any by-products which are hard to handle.

Vapor compression system such as refrigerators, heat pumps, air conditioners, refrigerant recovery equipment, refrigerant recycling equipment and refrigerant reclamation equipment must be concerned with the development of acids in the refrigerant which can severely shorten the life of the compressor and the refrigerant. These acids can be formed by chemical reactions of the refrigerant with system components and/or materials of construction, lubricating is oils, and/or impurities. The instability of the refrigerant, and thus the formation of acids, is accelerated by elevated temperatures resulting from improper system operation such as a failed condenser fan, a clogged air flow path and the like.

Checking the acid level in the refrigerant and/or oil is a common maintenance recommendation because acidic conditions can be cleaned up before a compressor motor burns out. If a compressor does burn out, the oil becomes extremely acidic. Then, all this acid must be removed or neutralized when the compressor is replaced or else the elevated acid levels will attack the new compressor and cause another compressor motor burn-out.

Acid cleanup normally involves changing the compressor oil and the refrigerant to reduce the acid level as well as changing the hermetic or semi-hermetic compressor in the case of burn out. Unfortunately, removal of the oil contained in the compressor does not remove all the oil or acid in the system because acid is carried throughout the vapor-compression loop by the flowing refrigerant, and therefore, acidic oil or its residue is found throughout the system. This residual acid has been shown to shorten the life of the system inasmuch as this residual acid will lead to accelerated acid formation in the system. Experimental studies in the literature support the view that after a burn-out the frequency of subsequent burn-outs increases.

The conventional way to remove the acidic residue throughout the system is by performing several flushes of the vapor-compression system with refrigerant to dissolve the oil and reduce the oil and acid concentrations by dilution. Because of EPA mandated refrigerant recovery requirements, however, this procedure is a costly and time consuming task, and the cost of the refrigerant used in the flushing operation is not insignificant. An alternative approach is to neutralize the acid by reacting the acid with a basic solution which, unfortunately, also results in the formation of undesirable salts.

Typical neutralization approaches neutralize the acid with a base, such as potassium hydroxide, as described in WO 94/10268. These bases are solids and are dissolved in a non-aqueous solvent such as an alcohol. In such a reaction, the acid and base combine to form a salt and water. While the water can be removed by the filter/dryer in the system, the salt remains in the system and can cause problems, such as clogging the thermal expansion valve (TXV) or causing corrosion if the salt is not removed by the filter/dryer.

Potassium hydroxide, like other base neutralizing materials, is a solid and must be dissolved into a liquid solvent carrier, such as an alcohol, or physically held in the flow of the vapor-compression system. The base cannot vaporize and therefore the transport of the base, even if dissolved in a liquid such as alcohol, is severely limited. Vaporization of the alcohol leaves the base as a solid residue. To avoid that problem, the aforementioned WO 94/10268 introduced the neutralization solution in the compressor discharge where it was forced through the condenser, filter/dryer, TXV, and evaporator, before being trapped in the compressor oil supply. The liquid neutralization solution is thereby forced to travel throughout the system before becoming trapped. The flashing at the Expansion Valve, such as a Thermal Expansion Valve or Capillary Tube can, however, also cause the alcohol to vaporize leaving a deposit of the solid basic material, such as potassium hydroxide, to clog the Expansion Valve. Even if the basic solution passes through the Expansion Valve, the alcohol might evaporate in the evaporator leaving the solid basic material in the evaporator.

Previous acid neutralization efforts have centered on neutralizing an acid with a base (solid bases dissolved in a liquid solvent) which results in the formation of salt and water. The solvent used to dissolve the base cannot be water because water will cause serious problems in the refrigeration system (e.g., frozen ice clogging the system) and the base does not dissolve in oil directly. WO 94/10268 proposes potassium hydroxide as the base and non-aqueous alcohol as the solvent to dissolve the base, the basic solution not being soluble in the oil. U.S. Pat. No. 3,119,244 proposes sodium bicarbonate as the neutralizing agent held in a cylinder designed so that the compressor fluid comes in contact with the bicarbonate soda and any acid is neutralized. However, the reaction will produce carbon dioxide, a non-condensable gas, which is also undesirable in the system. U.S. Pat. No. 5,015,441 proposes a basic aqueous solution to neutralize the acids in air compressors, but aqueous solutions are unacceptable in a refrigeration application.

In the previous efforts, the fundamental acid-base reaction was employed to neutralize the acid but has several major drawbacks. In particular, the acid-base reaction forms water and salt. Although the quantity of water formed is insignificant and is easily removed by the filter/dryer, the salt remains as a solid and is a significant problem. Also, the basic solution is a solid dissolved in a liquid. Therefore this neutralization solution is not easily transported into the normally vapor regions of the compressor, but rather tends to accumulate in the compressor's oil sump. Because the basic solution does not effectively travel throughout the system, it does not effectively neutralize the acids in the normally vapor regions of the system. With the acid-base neutralization reaction, any acidic component can only be neutralized by coming in contact with the solid base or the liquid basic solution, which does not vaporize, or by passing through the filter/dryer.

Another serious problem with the acid-base neutralization approach is that the base is a caustic compound, which can cause as much damage in the form of corrosion, motor winding insulation damage, leading to motor burn out and the like as the acid itself. Therefore, if the basic solution does not immediately encounter the acidic environment, which will probably be the case, the base itself will cause system damage. Also the proper quantity of base to add in order to properly neutralize the acid is difficult to determine in the field, inasmuch as the exact acid levels and the quantity of trapped oil is not well known. Furthermore, adding too much base, will result in an overall basic solution, which can cause further problems, and is just as bad as too acidic a system.

Although 2-propanol was proposed to be used as the solvent for the solid potassium hydroxide or other bases, the alcohol was not intended to be used as an acid liberation technique. Rather, the alcohol which serves as a nonaqueous solvent for the base being added to neutralize the acid is present solely to dissolve the solid basic material. The alcohol is used in a refrigeration system because, water is totally undesirable to dissolve the solid base material and non-aqueous alcohol is possibly the only choice as the solvent.

A discussion of the acids present in the system is necessary to fully understand the acid removal process of the present invention. Depending on the refrigerant and oil being used in the system, a refrigeration system can contain two types of acids, organic acids, such as oleic acid, which are soluble in the oil, do not vaporize and therefore stay predominantly in the liquid oil in the compressor oil sump, and inorganic (mineral) acids, such as hydrochloric acid, which are only slightly soluble in the oil. The organic acids are significantly less corrosive and only found in ester-based oil or in systems where a strong oxidizer and high temperatures are present. Consequently, significant quantities of organic acids are rarely, if ever, found in today's refrigeration systems.

Both inorganic and organic acids are nevertheless corrosive. Inorganic acids, especially hydrochloric acid, have higher dissociation constant, making them strong and very reactive acids, whereas organic acids react much more slowly. In addition, as noted above, organic acids do not form in refrigeration/air conditioning systems, or even if they do, it is in a very minute amount e.g., as 1 to 3 ppm as hydrochloric acid. In the case of mineral oils, elevated temperature causes the oil ultimately to break down and the resulting products are carbon and hydrogen gas. Only in the presence of an oxidizer, such as oxygen or air, can organic acids be formed. In the case of synthetic oils, organic acid may be initially present, up to 8 ppm, as a residual from the esterification manufacturing process used to make the ester oil. We have, therefore, recognized that the acid problem in refrigeration/air conditioning systems which use conventional refrigerants and oils is an inorganic acid problem, not an organic acid problem.

During a compressor-motor burn-out, inorganic acids are formed as a result of the refrigerant decomposition at elevated temperatures. These inorganic acids which are formed are slightly soluble in the oil. However, most of the inorganic acids generated during a motor burn-out remain in the vapor phase and react quickly with the materials of construction or are adsorbed in the filter/dryer. Experiments have shown that this inorganic acid vapor is gone within a matter of hours.

Experiments have also shown that inorganic acid is also dissolved in the oil (i.e., trapped in the oil due to foaming and agitation of the oil) and adsorbed onto the hard particles present in the oil. This inorganic acid will remain in the oil for a much longer period of time and this acid is in contact with the compressor components, including the motor windings. The inorganic acid in the oil will etch the lacquer insulation from the wire causing the motor winding to short-out electrically and resulting in a subsequent motor burn-out. Above an acid concentration of approximately 50 ppm, as hydrogen chloride, the compressor motor has been found to burn out quickly.

We have experimentally measured very high concentrations of inorganic acids in the compressor oil. Theoretically, the inorganic acid is not very soluble in the oil; however, this inorganic acid is trapped in the oil and/or adsorbed on the surface of the solid particles which are present in the acid oil resulting from a motor burn out. Stirring of the oil itself has not been found to release this trapped acid. In order to demonstrate the foregoing, an oil sample with an initial acidity value of 133 ppm as hydrochloric acid was vigorously stirred for 32 hours using a magnetic stirrer. The acidity dropped 45 percent to 73 ppm as hydrochloric acid at room temperature open to the atmosphere. At this acid level, the compressor would fail (burn-out) before sufficient acid could be liberated from the oil. That is, with an initial acid level of even 73 ppm, the compressor would burn-out in less than 32 hours of operation. If the trapped inorganic acid could be liberated from the oil as well as from the acidic surfaces in a reasonable time and vaporized, however, the existing filter/dryer in the system could remove this acid.

The ordinary filter/dryer in the vapor-compression system is a desiccant which will selectively adsorb water and then adsorb these inorganic acid vapors, assuming the filter/dryer is not already saturated with water. Therefore, if the acids are vaporized, a change of the filter/dryer will effectively remove the inorganic acids in the entire system.

An object of the present invention is to provide a method of liberating the trapped inorganic acid from the oil and acid contaminated surfaces. This object has been achieved by discovering the appropriate solvent for the inorganic acid but not for the oil. In other words, the solvent has to be immiscible with the oil.

Another key factor in finding the appropriate solvent is that it has to be volatile so it does not remain a liquid in the compressor oil, but vaporizes and travels through the system where it can be removed by the filter/dryer. Our method thus involves stripping the acid out of the oil. We have found that ethanol meets the foregoing criteria perfectly.

BRIEF DESCRIPTION OF THE DRAWINGS

These and other objects, features and advantages of the present invention will become more readily apparent from the following detailed description thereof when taken in conjunction with the accompanying drawings wherein.

DETAILED DESCRIPTION OF THE DRAWINGS

For comparison reasons, the previous preliminary experiment, i.e. vigorously mixing the oil for 32 hours to reduce the acid level in the oil by 45% was repeated with ethanol added to the oil prior to mixing. After 20 minutes, the ethanol was tested for acid and it was determined that 100% of the acid in the oil was removed from the oil and was dissolved in the ethanol. This demonstrates that the ethanol effectively strips the acid from the oil.

Figure 1:
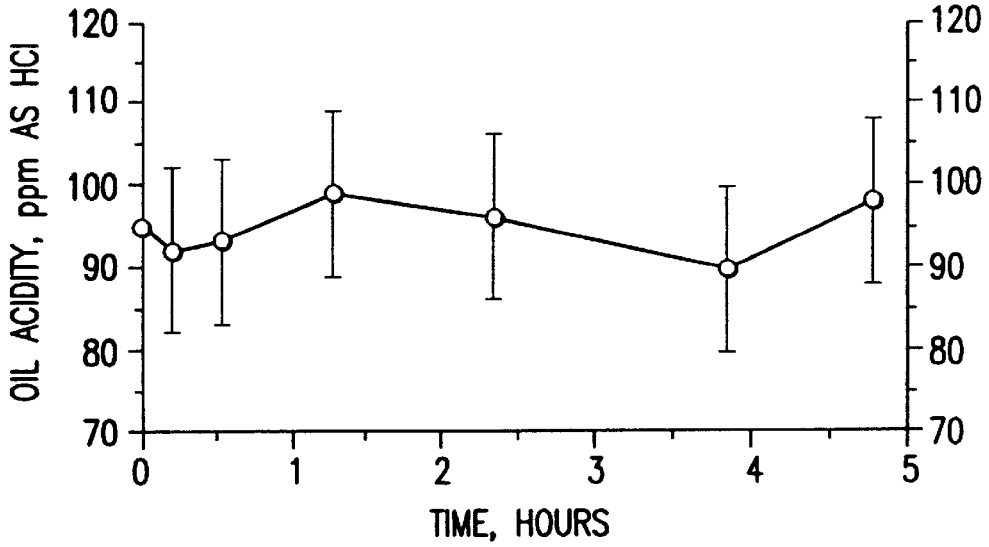
FIG. 1 is a graph of oil acid level over time illustrating the results of not adding to the compressor oil.

In this method it is necessary for the ethanol to vaporize so that the inorganic acid can react with surfaces or be adsorbed in the filter/dryer. To verify that the ethanol will vaporize in an actual refrigeration/air conditioning system, ethanol was introduced into an actual system. Initially, the compressor oil acidity was 120 ppm and the amount of oil in the crankcase was 200 grams. The amount of ethanol introduced in the compressor oil was 2 grams (1% of the oil weight). The ethanol was able to liberate the acid from the oil within 2 hours of operation in the actual system. As seen in FIG. 1, a similar demonstration was performed without adding ethanol, and there was no decrease in the oil acid level after 8 hours.

Other alcohols such as methanol and 2-propanol (isopropanol) can also be used, but it has been found that an alcohol that is not soluble in the oil is preferred because the alcohol is then more easily separated from the oil in the vapor compression cycle. Both methanol and 2-propanol were able to completely dissolve the acid and strip it out of the oil. However, methanol was slightly miscible with the oil and 2-propanol was completely miscible. The disadvantage of using a miscible alcohol is that it will take longer for the alcohol to separate and leave the oil. Therefore while ethanol, 2-propanol, and methanol would remove acid effectively, ethanol provides the best results for the current refrigerants and oils being used in today's refrigeration compressors.

Ideally the alcohol should be introduced into the compressors oil sump so that is can thoroughly mix with the oil during the lubrication of the compressor. The alcohol concentrations in oil are less than 10% and will not affect the lubrication properties of the oil. The mixing of the alcohol with the oil liberates the acid from the oil and acidic surfaces and the liberated acid dissolves in the alcohol. The alcohol is also vaporized, thereby leaving the oil, and travels through the system where it becomes adsorbed, along with the acid, in the system filter/dryer, e.g., a molecular sieve or activated alumina desiccant.

The net result of the foregoing procedure is that the acid is removed and no residue is left in the system, since both the acid and the alcohol are adsorbed by the filter/dryer. After about 8 hours or more of operation, the filter dryer is replaced. The system has been substantially cleaned of acid without leaving any residue. Furthermore, should alcohol be introduced when acid is not present, the alcohol will still vaporize and become adsorbed in the filter dryer, leaving no residue. Hence, attempting the acid liberation by the addition of alcohol will not have any harmful results, even if there is no acid in the system. With the conventional acid-base neutralization technique which forms a salt residue after the reaction, however, a caustic base is left in the system if no acid is present.

Figure 2:
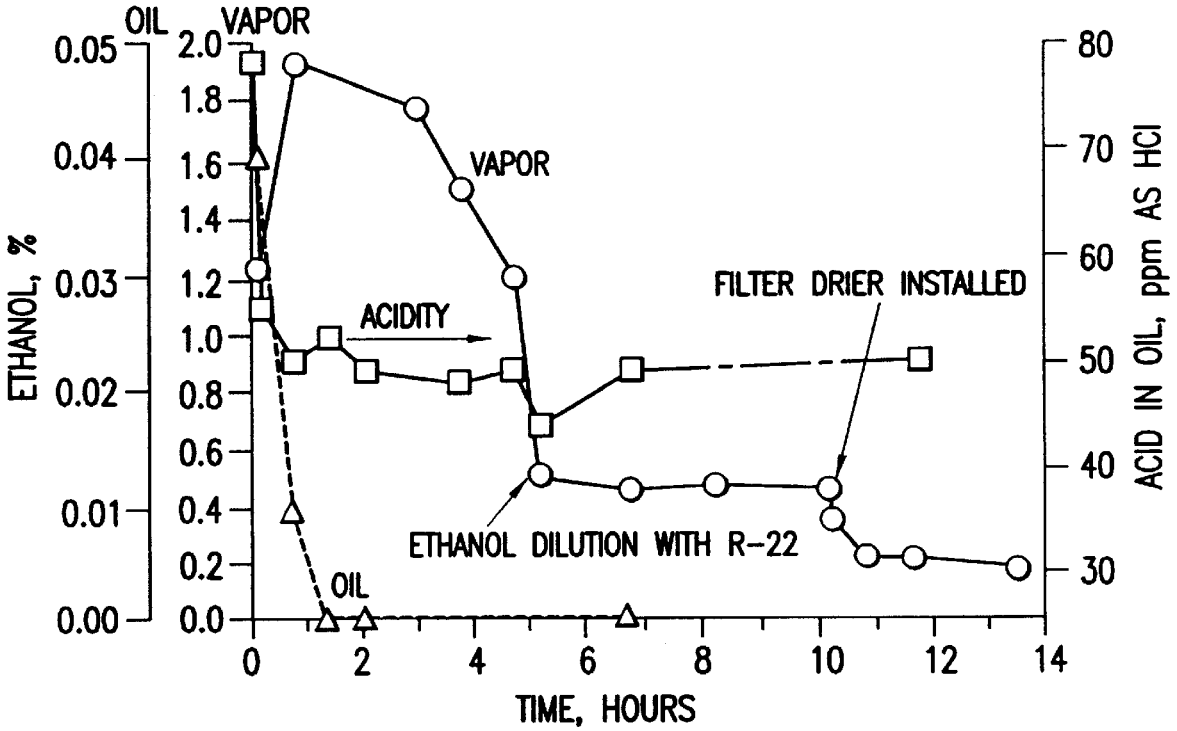
FIG. 2 is a graph illustrating the results of adding ethanol to the compressor oil but without a filter dryer.

The foregoing has been demonstrated by experiment. In the first part of a two part experiment, as seen in FIG. 2, ethanol was introduced into acidic oil without the presence of a system filter/dryer. Because the filter/dryer removes the alcohol and acid, the first part determined the time required to liberate the acid from the oil and measured the reduction of acid and ethanol in the oil as well as the increase of ethanol in the vapor.

Without the filter/dryer, the acid and ethanol cannot be effectively removed from the system. Note in FIG. 2 that the ethanol concentration in the vapor (the solid line) peaked at between 1.5 and 2 hours, and the ethanol (dotted line) and acid level (dot-dash line) in the oil dropped steadily from an initially high value. That is, the acid level in the oil dropped considerably from an initially dangerous level of 78 ppm to 50 ppm in only 4 hours.

Figure 3:
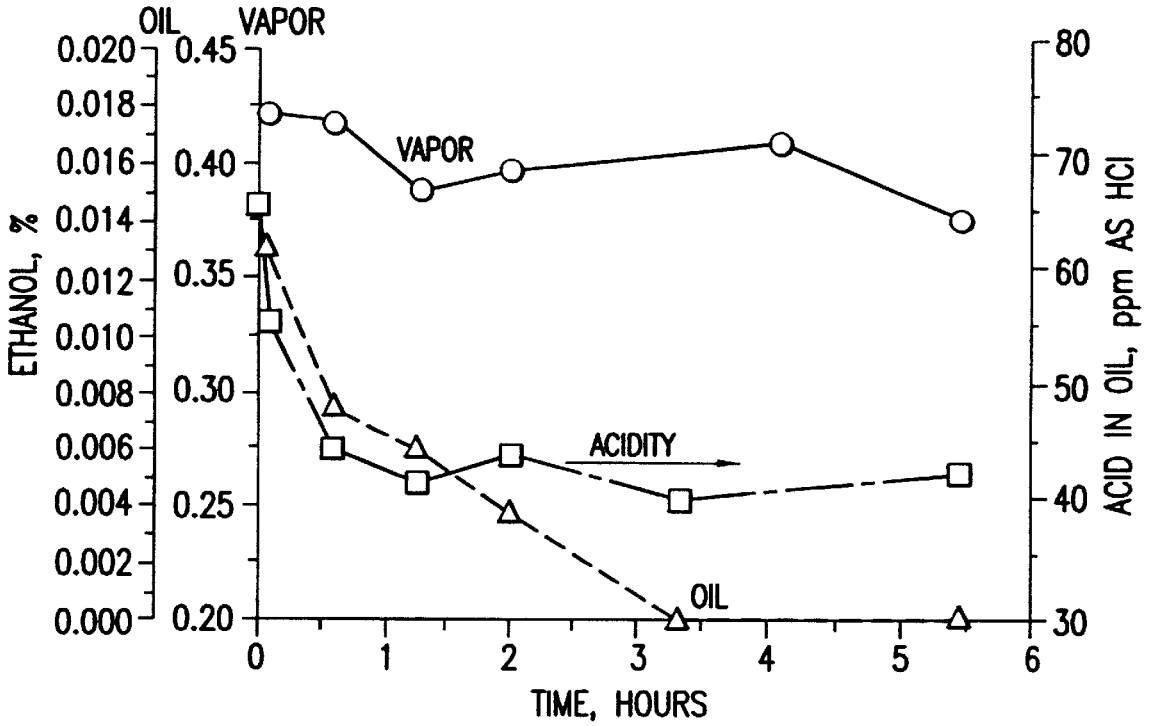
FIG. 3 is a graph similar to FIG. 2 but with the use of a filter dryer.

In the second part of this experiment, as seen in FIG. 3, the test was repeated except a filter/dryer was used to adsorb the acid and ethanol from the vapor. Note that no ethanol (dash line) exists in the oil after 2 to 3 hours of operation. This method significantly removes the majority of the acid from the oil and leaves no residue.

If organic acids are present for any reason, this addition of the alcohol also has the benefit of neutralizing the organic acids by an esterification reaction. As noted earlier, the presence of organic acid in a refrigeration/air conditioning system is not normally possible unless large quantities of oxygen or air is present in the system, or the refrigerant composition has been changed from the current chemical formulations. In an esterification reaction, the organic acid and alcohol react to form an ester and water. Again, as in the acid-base reaction, the water by product can be easily removed by the filter/dryer and the quantity of water formed is not excessive. The key to this approach is that the ester formed in this acid neutralizing esterification reaction has no negative effects on the system, because it is essentially a lubricant.

This reaction only neutralizes the organic acids and is catalyzed by inorganic acids. The inorganic acids, whose presence is required for the esterification reaction, will always be present if organic acids have been formed. Again, as with the inorganic acid, the alcohol, which is necessary for the esterification reaction can be easily vaporized and therefore will travel throughout the system. Thus, any trapped organic acid will be quickly neutralized anywhere in the system.

In our acid removal method, the quantity of alcohol introduced is determined from the capacity of the filter/dryer. The quantity of added alcohol is determined so that all the alcohol can be removed by the filter/dryer after it has liberated the acid in the system. Alcohols are also compatible with the seal materials in vapor-compression systems.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A method of removing inorganic acid, to the extent present, from oil in a vapor compression system comprising the steps of introducing an alcohol-containing composition into the system, which composition is a solvent for the inorganic acid but not for the oil, separating the composition containing the acid from the oil, and removing the separated acid-containing composition from the system.

2. The method according to claim 1, wherein the system is one of a refrigerator, a heat pump, an air conditioner, a refrigerant recovery apparatus, a refrigerant recycling apparatus and a refrigerant reclamation apparatus.

3. The method according to claim 1, wherein the step of removing the separated acid-containing composition comprises passing a vaporized solvent into a filter/dryer.

4. The method according to claim 3, wherein the alcohol of the alcohol-containing composition is selected from the group consisting of ethanol, methanol and isopropanol.

5. The method according to claim 4, wherein the alcohol of the alcohol-containing composition is immiscible with the oil.

6. The method according to claim 3, wherein the step of introducing comprises providing a quantity of the alcohol containing composition based on adsorption capacity of a filter/dryer.

7. The method according to claim 1, wherein the system includes a compressor, and the step of introducing comprises introducing the composition into an oil sump of the compressor.

8. The method according to claim 7, wherein the alcohol in the alcohol-containing composition is selected from the group consisting of ethanol, methanol and isopropanol.

9. The method according to claim 8, wherein the alcohol-containing composition is immiscible with the oil.

10. The method according to claim 9, wherein the step of removing the separated acid-containing composition comprises passing a vaporized solvent into a filter/dryer.

11. The method according to claim 10, wherein the system is one of a refrigerator, a heat pump, an air conditioner, a refrigerant recovery apparatus, a refrigerant recycling apparatus and a refrigerant reclamation apparatus.

12. A method of using alcohol-containing composition to remove inorganic acid from oil in a vapor compression system comprising the steps of introducing the alcohol-containing composition into a vapor compression system, and separating and removing the inorganic acid from the oil.

13. The method of use according to claim 12, wherein the system is one of a refrigerator, a heat pump, an air conditioner, a refrigerant recovery apparatus, a refrigerant recycling apparatus and a refrigerant reclamation apparatus.

14. The method of use according to claim 12, wherein the alcohol of the alcohol-containing composition is selected from the group consisting of ethanol, methanol and isopropanol.

15. The method of use according to claim 14, wherein the alcohol-containing composition is immiscible with the oil.

* * * * *